United States Patent [19]

Provost et al.

[11] Patent Number: 4,884,323

[45] Date of Patent: Dec. 5, 1989

[54] QUIET TOUCH FASTENER ATTACHMENT SYSTEM

[75] Inventors: George A. Provost; Rita T. Bahro, both of Manchester, N.H.

[73] Assignee: Velcro Industries B. V., Amsterdam, Netherlands

[21] Appl. No.: 143,979

[22] Filed: Jan. 14, 1988

[51] Int. Cl.[4] ..... A44B 18/00

[52] U.S. Cl. ..... 24/442; 24/444; 24/306; 2/DIG. 6

[58] Field of Search ..... 24/442, 443, 444, 445, 24/447, 448, 451, 306; 156/280, 222; 428/138; 2/DIG. 6, 161 R, 167; 70/456 B

[56] References Cited

U.S. PATENT DOCUMENTS

| | | | |
|---|---|---|---|
| 1,301,955 | 4/1919 | McKechnie | 156/280 |
| 3,256,882 | 6/1966 | Huber | 2/DIG. 6 |
| 3,455,589 | 7/1969 | Valiulis | 24/442 |
| 3,469,289 | 9/1969 | Whitacre | 24/442 |
| 3,726,752 | 4/1973 | Provost | 24/444 |
| 3,849,840 | 11/1974 | Yamada et al. | 24/448 |
| 4,054,952 | 10/1977 | Swallow | 24/306 |
| 4,072,033 | 2/1978 | Eckerdt | 70/456 B |
| 4,247,586 | 1/1981 | Rochlin | 156/222 |
| 4,355,424 | 10/1982 | McCoy, Jr. | 2/161 R |

FOREIGN PATENT DOCUMENTS

| | | | |
|---|---|---|---|
| 1080653 | 8/1967 | United Kingdom | 24/442 |
| 2160586 | 12/1985 | United Kingdom | 24/442 |

*Primary Examiner*—Victor N. Sakran

*Attorney, Agent, or Firm*—Hayes, Soloway, Hennessey & Hage

[57] ABSTRACT

A touch fastener mounting system having a touch fastener component attached to a member and adapted to releasably engage a mating touch fastener component. The touch fastener mounting system having a touch fastener component comprising a planar backing material carrying engaging elements on one surface thereof, the other surface of the backing material is connected to the member so that the member is isolated from the backing material whereby, upon separation of the engaged touch fastener components, the amount of noise-producing energy transmitted from the backing material to the member is decreased thereby reducing the amount of noise produced by the member. In a second embodiment, the noise producing energy is transmitted to the member and dampened by a high mass material attached to a rear surface of the member.

21 Claims, 5 Drawing Sheets

QUIET TOUCH FASTENER ATTACHMENT SYSTEM

BACKGROUND OF THE INVENTION

The present invention relates to touch fasteners and, more particularly though not exclusively, to an attachment system for attachment of a quiet hook and loop touch fastener material to a surface such that a reduced sound level is produced during rapid separation of the touch fastener by comparison with prior art attachment systems.

The term "touch fastener", as employed in this application, comprises two components, namely, a first planar backing material having a surface carrying hooks, mushrooms, balls on stems, pigtails, or the like, capable of engaging loops, hooks, mushrooms, balls on stems, pigtails, or the like, carried by a second planar backing material to releasably fasten items together, such as those products sold by the assignee of the present invention under the trademark VELCRO.

Touch fastener materials have grown rapidly in public acceptance and their uses appear unlimited. Unlike other devices such as zippers, and the like which require proper alignment and component tolerances to operate and not jam, touch fasteners are virtually indestructible and need only be pressed together with mating surfaces in contact with one another to effect attachment. For belts, and the like, they provide infinite adjustment capabilities. All this is to say that they are very well suited for military applications where such qualities are important and appreciated.

Unfortunately, touch fastener materials according to the prior art have suffered from a single drawback which has caused concern in some military applications as well as annoyance to certain other users—noise upon separation. Typical VELCRO brand hook and loop type touch fastener material and the noise associated therewith is shown in simplified form in FIGS. 1–3. As depicted in FIG. 1, the touch fastener material 10 comprises a first planar backing material 12 having an engaging elements thereon comprising, for example, resiliently flexible J-shaped hooks 14 attached to the backing material 12 at discrete points. Touch fastener material 10 also includes a second planar backing material 16 having mating elements thereon such as, for example, loops 18. The touch fastener material 10 is releasably engaged by pressing the hooks 14 into engagement with the loops 18 where they are ensnared to hold the two portions together as shown in FIG. 2. Like zippers and their characteristic "zipping" noise, conventional touch fastener materials are easily identified by their characteristic "ripping" noise 20 when the two portions are peeled apart as depicted in FIG. 3.

The problem of noise produced by a touch fastener is addressed in copending U.S. patent application Ser. No. 921,731 filed on Oct. 20, 1986, now U.S. Pat. No. 4,776,068 assigned to the assignee of the present application. However, when a quiet touch fastener, as disclosed in that application, is attached to a garment or other member, such as a pocket closure, it has been found that much of the "noise" reduction achieved by the techniques of said application are lost due to the secondary noise emission of the garment when the fastener components are separated. This is a result of the prior art modes of connection, e.g. stitching, glue, etc., which directly couple the touch fastener backing to the garment whereby noise producing energy is readily transmitted therebetween. Such prior art connections negate, to a large extent, the noise reduction achieved in the quiet touch fastener itself.

Wherefore, it is an object of the present invention to provide an attachment system for attaching a touch fastener, especially a quiet touch fastener, to a member so that the touch fastener is isolated or decoupled from the attached member to thereby decrease the amount of noise producing energy transmitted to the member and reduce the amount of noise produced by the member upon separation of its attached touch fastener.

A further object is to provide a touch fastener which is attached to a member wherein a substantial portion of the noise producing energy transmitted to the member is damped or absorbed to thereby reduce the amount of noise generated by the member upon separation of its attached touch fastener.

SUMMARY

The foregoing objects have been realized by touch fastener material, attached by attachment means to a member, and adapted to releasably engage a mating fastener and produce reduced sound during rapid separation of two engaged touch fastener materials comprising: a touch fastener component having a planar backing member carrying engaging elements extending at discrete points from one surface thereof, the other surface of said backing member being attached by attachment means to a first member; said touch fastener component being capable of engaging elements of a mating fastener component, carried by a second member, to releasably fasten said first member to said second member; the attachment means including means for isolating said first member from noise producing energy generated by said backing member upon separation of said mating fastener components.

In a second embodiment, a high mass member, relative to the mass of the garment, is positioned behind the garment and attached thereto for dampening the noise producing energy transmitted from the backing member to the garment.

DESCRIPTION OF THE PREFERRED EMBODIMENTS

A first part of the solution to the noise problem of touch fastener material which led to the development of the product line to be marketed by the assignee of this application under the trademark STEALTH VELCRO was disclosed in U.S. Pat. Application Ser. No. 921,731 filed on Oct. 20, 1986. The research described hereinafter was done on hook and loop fastener materials; however, the finding would be relevant to all touch fastener materials.

It was initially assumed (inaccurately, as later discovered) that the bulk noise came from vibration of the hooks 14. At first, the noise was attempted to be characterized with measurements of individual hook and loop radiation. It was ultimately discovered that the original assumption was not correct because the sound pressure level from an individual hook was quite low, and the oscillation, when it could be measured, was well up into the high frequency range greater than 10 kHz.

Figure 1:
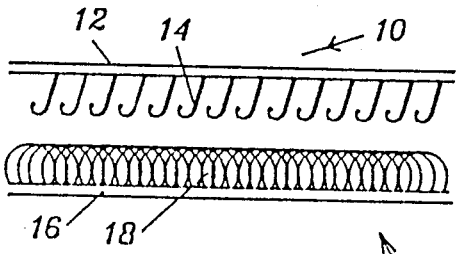
FIG. 1 is a simplified drawing of touch fastener material of the hook and loop type showing the components thereof in their separated state.
Figure 2:
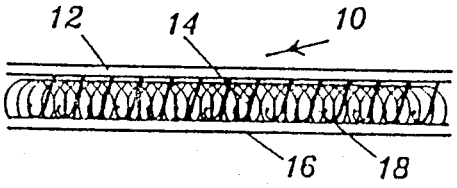
Fig. 2 PRIOR ART
FIG. 2 is a simplified drawing of touch fastener material of the hook and loop type as in FIG. 1 showing the components thereof in their joined state.
Figure 3:
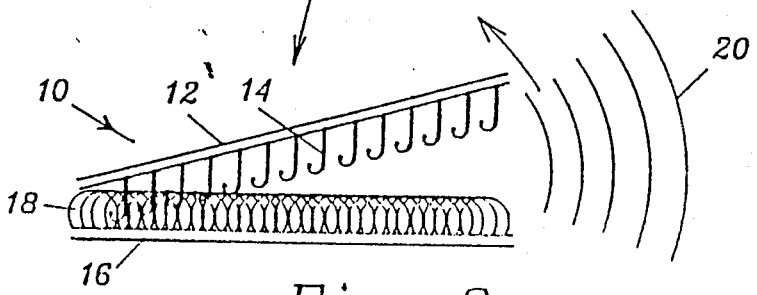
FIG. 3 is a simplified drawing of touch fastener material of the hook and loop type as in FIGS. 1 and 2 showing the noise production problem.
Figure 4:
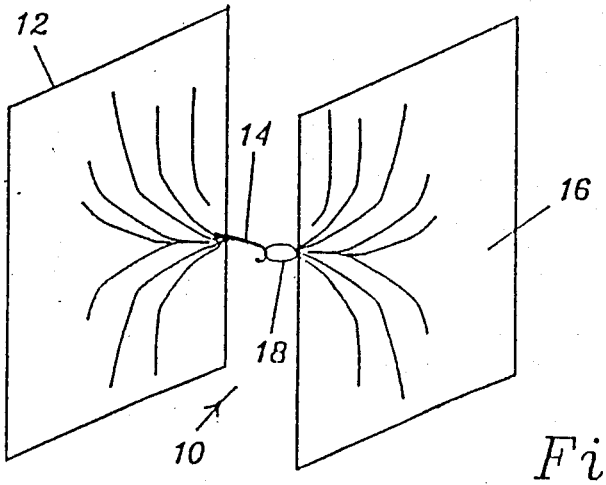
FIG. 4 is a simplified drawing illustrating the cause of the problem.

This led to the creation (i.e. development) of a different theoretical model as shown in simplified form in FIG. 4. This was one of a membrane or plate, given an initial deflection as a result of the tension created in a hook/loop pair, just prior to the moment of disengagement. Thus, it was now (accurately, this time) assumed that the backing materials 12, 16 act much like a speaker cone or sounding board; that is, once the hook and loop are released, the deflected portions of the backing strips surrounding discrete points of attachment to the engaging surface materials tend to restore themselves to their original flat shape and, in doing so, produce the noise that is heard. Once this had been established, the search for a solution focused on mechanisms to defeat the conversion of this "diaphragm" or deflected plate motion into air-borne noise.

The sound power generated in the near field of this action in a flat plate is determined by the relationship:

$$wp \sim \frac{F^2 \rho_{air}}{2\pi(\rho_{plate})^2 C}$$

where

F = the force input (in our case tension)

$\rho$air = the density of the air

C = the velocity of sound in air $\rho$plate = the aerial density of the plate.

Based upon the above-described relationship, it became clear that one could hope to achieve the desired sound reduction by (1) reducing the force (i.e. the tension) of the hooks 14, (2) increasing the density of the plate, (3) decreasing the ability of the plate to couple the sound into the air, or (4) decreasing the effect of the force in deflecting the plate. Connection (or tear) strength is the most desirable quality of the product and, therefore, it must be maintained—thus eliminating option (1) above and leaving those options effecting the aerial density of the plate as the parameters of possible control and/or alteration to obtain the desired results in noise reduction.

Figure 5:
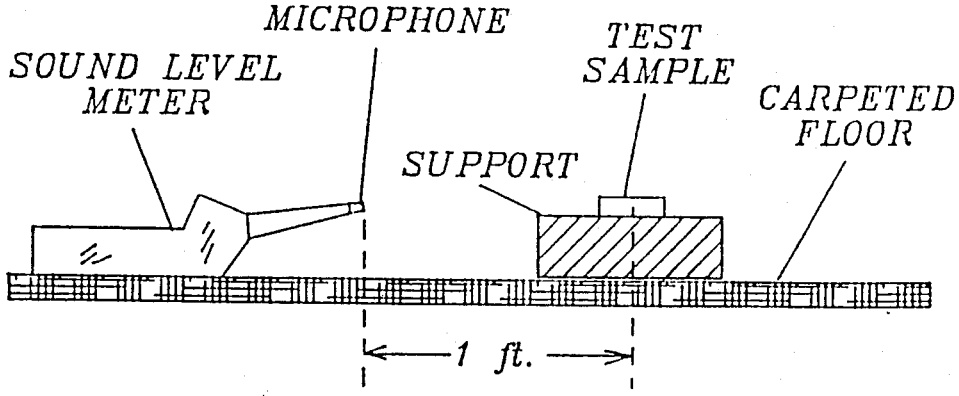
FIG. 5 is a drawing showing the testing apparatus employed in developing and testing the present invention.

To investigate cause and effect in the pursuit of a quite touch fastener material, the test setup of FIG. 5 was employed. By varying the mass of the support to which the fastener materials 10' were attached, the mass of the backing material could be varied up to a virtual infinity level. Primary emphasis was initially made on the hypothesis that as mass was added to the hook and loop tape, the noise produced upon separation should decrease, and furthermore, the relationship should be logarithmic in nature. To investigate the correctness of the hypothesis, a series of samples were prepared, as was a reference standard. The reference standard consisted of a massive structural member chosen to contribute a minimum of acoustical input, namely a steel bar $\frac{3}{4}$ in. × 2 in. × 6 in. to which was rigidly bonded both hook and loop tape, each on either side, and was used as the mating half for various embodiments under investigation. A 1-slug (32 lb.) lead brick was later used as contributing even less noise to the noise of separation. Using the test setup of FIG. 5, data was collected on a variety of samples each having been bonded to a backing material having different aerial density ranging from paper through lead doped vinyl to lead sheet (1/16 in.) and finally on to a 1-slug (32 lb.) lead brick. The measurements involved the measurement of dB(A) on a IEC651 type 1L meter (according to ANSI 51.4-1983 type 1) set to measure RMS, fast response, random incidence at 1 foot from the fastener noise produced at a separation rate of about 6 inches/second (which is believed representative of a normal separation rate of between about 3 and about 12 inches/second for touch fasteners, particularly hook and loop fasteners).

Figure 6:
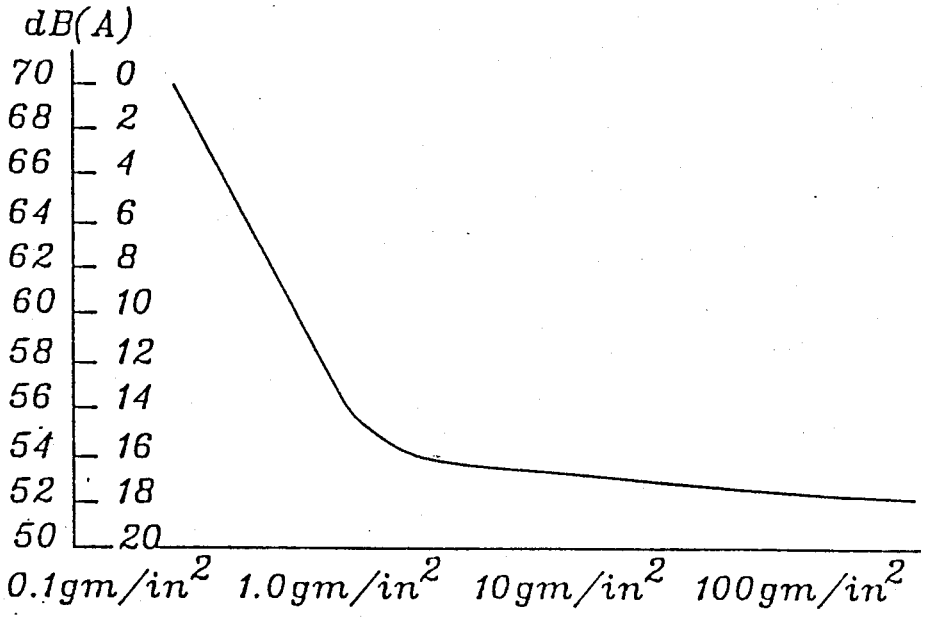
FIG. 6 is a graph showing test findings relative to noise as a function of the mass of the backing material of the touch fastener material.

FIG. 6 illustrates the data and the relationship between aerial density (mass) and noise. A relationship is evident throughout the first order of magnitude of mass. The plot indicates that sound pressure level in dB(A) reduces by approximately 4.2 dB for each doubling in aerial density. This relationship appears to diminish greatly after aerial density is increased approximately 40 fold. This is not of great concern, however, since the test data indicates that only a moderate increase in mass would be necessary in order to diminish the noise to a commercially acceptable level.

A second thrust was then taken and investigated relative to the diminishing of the noise level. This is shown in simplified form in FIGS. 8 and 9. While the mass addition method described above was directed to limiting the velocity and displacement of the oscillating diaphragm created by the backing upon hook release, the alternate method was directed to reducing both the area and coupling efficiency between the diaphragm (backing) and the atmosphere. This was based on the alternate hypothesis that noise could be reduced by opening the structure to the passage of air so that, as it vibrates, the air simply flows from one side to the other; that is, if the backing were in the form of a lattice structure like that of a tennis racquet, radiation would take place from strings or linear members rather than from a plate or membrane and, therefore, the efficiency of coupling into the surrounding air would be greatly reduced.

Figure 7:
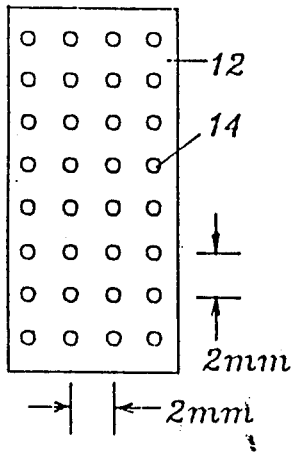
FIG. 7 is a simplified drawing showing the construction dimensions of prior art touch fastener material as tested and compared for noise producing qualities.
Figure 9:
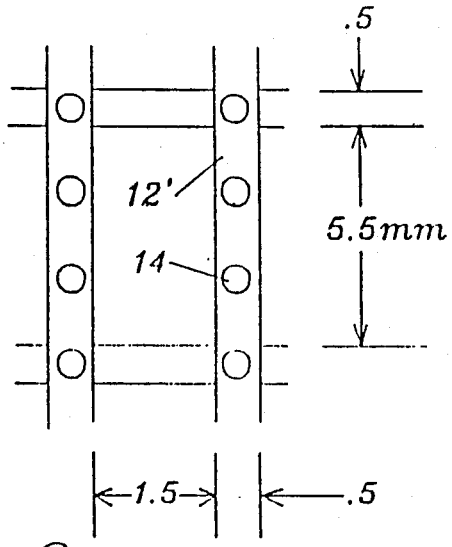
FIG. 9 is an enlarged drawing of a portion of the material of FIG. 8.
Figure 8:
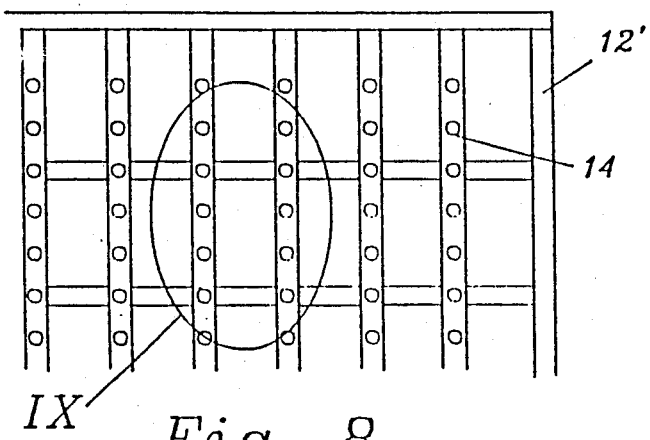
FIG. 8 is a simplified drawing showing the construction dimensions of touch fastener material for achieving noise reducing qualities.

To investigate this approach, samples were specially prepared by injection molding in both countinuous membrane and open "net" type construction as illustrated in FIG. 7 and FIGS. 8 and 9, respectively. It was anticipated, that, for significant results, the open area of the net should be greater than 50 percent; and, in the tested embodiment, actually represented approximately 70 percent of the total area. Aside from this difference, all aspects of the samples (e.g. hook shape, hook spacing, material, etc.) were the same as in the samples used in the increased mass testing described above. Acoustic comparisons of the two samples revealed that the net construction of FIGS. 8 and 9 was responsible for a 10 to 12 dB(A) decrease in sound power or noise level. It is believed that part of the noise reduction realized was due to a reduction in the area available for radiation. Thus, in reducing the area by 70 percent, a reduction in sound power of approximately 5 dB (i.e. $10 \log \times 1/(1-0.7)=5.23$) was expected. This, however, explains only about one-half the actual observed reduction. The remainder is thought to be due to the reduced efficiency of coupling a moving string or net to the air; i.e., the air is free to flow around the string as it moves and coupling is simply not accomplished effectively. Since it was decided to develop the commercial embodiment in the manner of the first approach described above through increased mass of the backing material, further in depth research on the "net" backing was not pursued.

Figure 10:
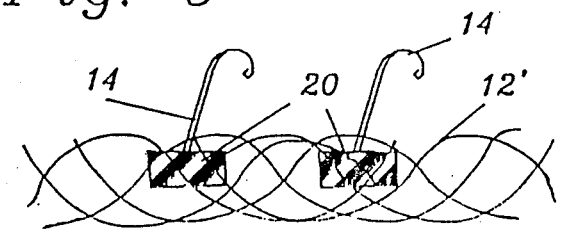
FIG. 10 is a simplified drawing showing the construction of a second embodiment of touch fastener material for achieving noise reducing qualities.

The test results did indicate, however, that a third viable approach could be employed which, because of its complexity on a commercial basis, was bypassed with respect to actual testing. That approach is the mounting of the hooks to the backing material at their discrete points of attachment with a decoupling material whereby the tension on the hooks is not reduced for purposes of grip strength of the touch fastening material; but, has reduced transmission or coupling into the backing material. It is contemplated, that, for example as shown in simplified form in FIG. 10, the hooks 14 could be attached to the backing material 12 by means of an elastomeric material 22 which would stretch during separation and thereby eliminate or absorb part of the deflection of the backing material 12.

Figure 11:
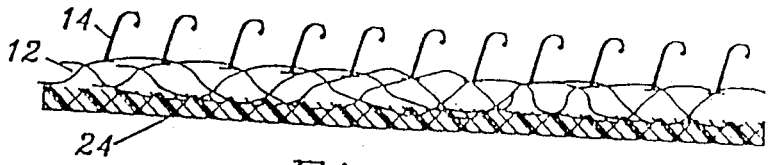
FIG. 11 is a simplified drawing showing the construction of a third embodiment of touch fastener material for achieving noise reducing qualities.
Figure 12:
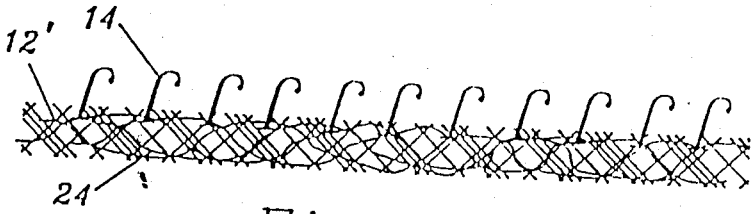
FIG. 12 is a simplified drawing showing the construction of a fourth embodiment of touch fastener material for achieving noise reducing qualities.

In FIG. 11, standard backing material 12 with standard hooks 14 thereon has a mass-increasing material 24 bonded to the back surface thereof. In tested embodiments, the material 24 has comprised leaded vinyl. It is assumed, however, that other materials exhibiting the same qualities and characteristics could be employed with equally beneficial results.

Figure 13:
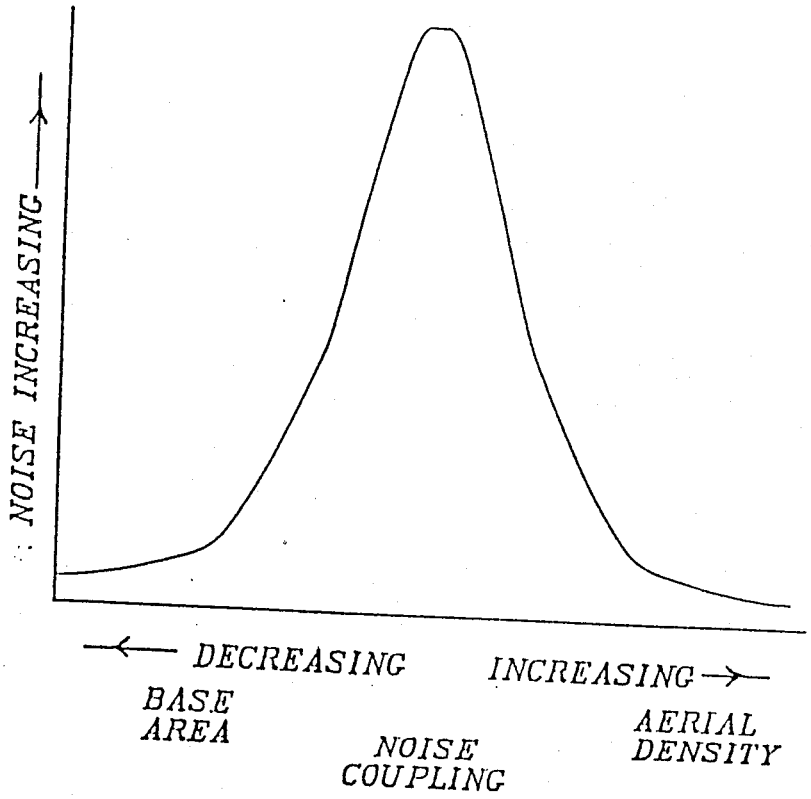
FIG. 13 is a graph showing the effect of general approaches to reducing noise in touch fastener material.

The findings of the testing are summarized in the graph of FIG. 13. As shown therein the prior art construction for touch fastening materials happens to fall on a maximum noise producing point. By increasing the aerial density of the backing material, the noise can be significantly reduced. Similarly, by decreasing the base area of the backing material, a significant noise reduction can be realized.

The foregoing background information relates to reducing the noise level of unattached touch fasteners. However, Applicants have found that once the aforementioned quiet touch fasteners are attached to garments or the like, they may produce noise levels approaching that of the attached original, non-quiet, touch fastener members. This, in turn, led to the present development.

The noise generated by a touch fastener when it is connected to a garment appears to result from the fact that the garment acts as a speaker cone which radiates sound which corresponds to its vibrational frequency. In a first approach for reducing the sound radiated by the garment the touch fastener is attached to a garment having a high mass component, e.g. a lead backing such as lead vinyl, attached to its rear surface. The noise level produced upon separation of the touch fastener is substantially reduced to that of an unattached, preferably quiet, touch fastener. The reason for this is that the high mass component dampens most if not all of the velocity and displacement energy transmitted from the backing material 12 to the garment base material 50 (see FIG. 16) for a given input excitation. However, the technique of adding mass to the garment may be unacceptable for some applications, especially military, where extra weight is preferably avoided.

A second approach to reducing the noise produced upon separation of touch fastener components is to perforate the garment so that it is rendered substantially ineffective as a radiator of noise. This approach may be impractical in some applications (for aesthetic reasons or because the garment can not be changed). Consequently, the present invention contemplates also the reduction of the velocity and displacement energy of the secondary radiator (i.e. the garment) without changing its radiation efficiency, whatever it may be in a given situation.

It has been found that the energy produced from releasing the engaged touch fastener members flows into the backing material, through the attachment means, and then into the garment which transmits the energy as sound. Each of these three elements (the backing material, attachment means and garment) generates sound in proportion to its vibration velocity and its radiating efficiency. When dealing with the backing material, there is little which can be done to reduce its vibrational velocity so effort was directed at reducing its radiating efficiency. When dealing with the garment, there is little which is appropriate, in many applications, to modify its radiating efficiency and thus reducing its vibrational amplitude and velocity is desired.

In a third approach sound reduction is accomplished in two steps: first, by reducing the vibrational energy that is transmitted from the backing material to an attachment member and secondly, reducing the energy passed through the attachment member to the garment. In acoustical terms, this could be accomplished by providing an impedance mismatch at the attachment boundaries, i.e., the interface between the backing material and the attachment member and the interface between the attachment member and the garment. Impedance mismatching requires that the impedance of the attachment member be significantly different than that of both the backing material and the garment. This technique will work if the impedance of the attachment member is either much higher or much lower than that of the garment and the backing material.

The most practical approach for this embodiment is to select the low impedance route. For this to be successful, the impedance associated with every possible mode of energy transmission between the backing material and the garment must be reduced. There are three predominant modes of energy transmission: 1) direct contact between the backing and the garment; 2) longitudinal vibration in the attachment material (i.e. waves that are transmitted along the attachment member when it is under tension); and 3) transverse vibration in the attachment material (i.e. oscillation waves which are transverse the thickness of the attachment member). The first mode should be avoided while the touch fastener is being separated, unless adequately dampened by a high mass backing, while the second and third can be controlled through proper design of the attachment means.

The impedance to longitudinal waves is controlled by three parameters: 1) the modulus; 2) the width; and 3) the thickness and length of the attachment material. Minimization of transmission of these waves is accomplished by selecting a low modulus material, by reducing its thickness and length, and increasing its width. It is clear that a low modulus attachment material is desirable.

The intermediate fabric modulus is important because it determines what the effective spring constant is for a given situation. The spring constant can readily be determined from the formula:

$$K = \frac{ETl}{L}$$

where

K=spring constant (F/distance (x))
E=modulus of the intermediate member
T=thickness of the intermediate member
L=length of the intermediate member
L=width of the intermediate member The impedance to transverse waves is controlled by two parameters: 1) the tension of the attachment material and 2) its surface density. Minimization of the transmission of vibrational energy is accomplished by selecting a light weight attachment material and spreading the attachment load across the entire length of the backing member so that concentration of energy at a few localized is avoided. The essence of the present invention is to reduce the garment's sound radiation upon seperation of an attached touch fastener. It has been found that the intermediate material used to decouple or isolate the backing from the garment or base material is very important in reducing the amount of transmitted energy. There are a large number of materials which can be utilized for this purpose and naturally some perform better than others. As mentioned, it has been found that the amount of transmitted energy is directly related to the physical properties of the attachment material, i.e. the type of weave, the type of yarn or thread utilized, its modulus, the fiber denier, etc., interconnecting the backing material and the garment.

The present inventors have found that soft fabrics with interwoven or knit type weaves have good isolating characteristics while fabrics with hard surface finishes and/or perpendicularly aligned threads have poor isolating characteristics. By and large, the more elastic the threads and/or weave of the intermediate fabric the more effective the fabric is for reducing the noise producing energy transmitted from the backing member to the reclosable member. The Applicants have found that materials such as spandex fabrics (LYCRA and BLACK LYCRA), power net fabrics, non-woven fabrics, braided fabrics, diamond meshed fabrics, foam materials, and other elastomeric fabrics work well in isolating the backing member from the member. The above list is not meant to be complete and is only given as representative samples of the type of materials which may be utilized as the intermediate member.

Figure 14:
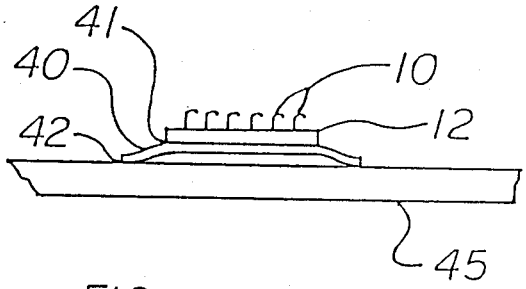
FIG. 14 is a simplified cross sectional view showing the attachment of the touch fastener to a member in a first embodiment of the present invention.

In a preferred embodiment of FIG. 14, one of the aforedescribed quiet touch fastener components represented as 10 is carried by backing material 12 and attached to an intermediate member 40, wider than the backing material, by stiching, an adhesive or other attachment means 41 intermediate its edges. The intermediate member 40, in turn, is attached adjacent its edges to a member 45 by adhesive, stiching, or other attachment means 42. The intermediate member provides isolation of the noise producing energy transmitted from the backing member 12 to the member 45, upon separation of two engaged touch fasteners.

Figure 15:
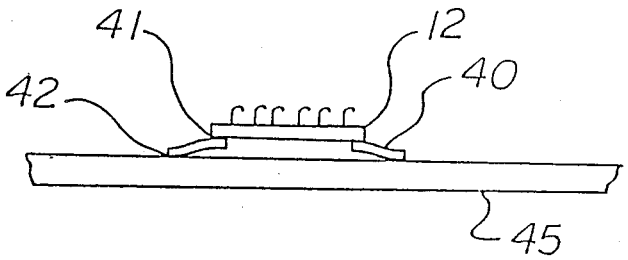
FIG. 15 is a simplified cross sectional view showing the attachment of the touch fastener to a member in a second embodiment of the present invention.

FIG. 15 is a second embodiment, similar to FIG. 14, in which the backing material 12 has each of its longitudinal edges attached at 41 to a separate single narrow strip intermediate member 40. Each narrow strip is then attached at 42 to the member 45. The noise reduction achieved by the arrangements of FIGS. 14 and 15 are substantially comparable to one another so that either configuration may be satisfactorily utilized. In both embodiments, the backing material is pulled away from the garment, upon separation of the touch fasteners, so that the only way energy can be transmitted between these two components is through the intermediate member or the surrounding air. Thus, when a quiet type touch fastener is connected to the garment by an intermediate member having the aforementioned desirable characteristics, the sound reduction of the quiet touch fastener will be maintained.

Figure 16:
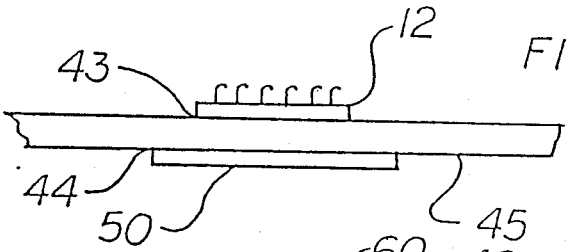
FIG. 16 is a simplified cross sectional view showing the attachment of the touch fastener to a member in a third embodiment of the present invention.

FIG. 16 shows a further embodiment for reducing the sound produced by the garment upon separation of engaged touch fasteners by substantially absorbing and dampening most of the energy transmitted to member 45. This is achieved through utilization of a heavy mass material such as a lead vinyl material. In FIG. 16, the backing material 12 is attached at 43 directly to the front surface of the member 45 which, in turn, then has the heavy mass backing material 50 attached at 44 to the rear surface thereof. This arrangement substantially reduces the ability of the garment to radiate sound by absorbing or dampening most of the vibrational energy transmitted from the backing member 12 to the garment or member 50.

Figure 17:
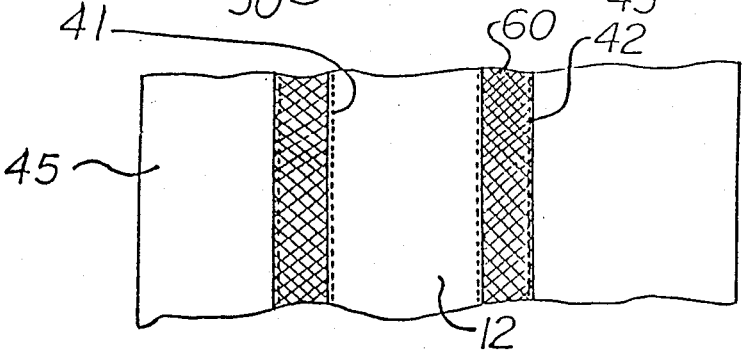
FIG. 17 is a plan view showing the attachment of a touch fastener to a member in a fourth embodiment.

Turning now to FIG. 17, it can be seen that the backing material 12 can be attached to a diamond mesh intermediate member 60 by stitching 41, or other attachment means. The diamond mesh member 60 is then attached by stitching 42, or other attachment means, to the member 45. It is to be noted that in this arrangement the threads of the diamond mesh member 60 are not aligned normal to the edges of the backing material 12. It is preferred that the threads be aligned at between a 30 and 60 degree angle with the edge of the backing material 12. This arrangement helps to distribute the noise producing energy generated by the backing material 12 over a greater surface area of the member 45.

The noise produced upon separation of attached quiet touch fasteners was measured for a number of test samples to determine the decoupling effectiveness of various intermediate members. The test samples consisted of quiet touch fasteners which were first stitched to a decoupling (intermediate) material which, in turn, was then stitched directly to a GORTEX brand waterproof base fabric. A mating quiet touch fastener was similarly attached so that when the two touch fasteners engaged and disengaged, this action would typify the opening and closing of a pocket closure for a military outer garment. A control sample was also assembled whereby mating quiet hook and loop touch fasteners were each stitched directly onto a GORTEX brand waterproof base fabric. Sound measurements were made on all of the test samples and compared against the control sample and an unattached quiet touch fastener sample. The results are tabulated below.

| MATERIAL DESCRIPTION | WEIGHT oz/sq yd | THICKNESS in | NOISE LEVEL db | CHANGE(*) COMPARED TO UNATTACHED db | CHANGE(**) COMPARED TO CONTROL db |
|---|---|---|---|---|---|
| nylon ripstop | 2.1 | .006 | 77 | +17 | −2 |
| nylon taffeta | 3.1 | .009 | 74 | +14 | −5 |
| polyester/Creslan acrylic | 5.5 | .065 | 74 | +14 | −5 |
| cotton/ polyester | 7.7 | .026 | 73 | +13 | −6 |
| cotton twill | 7.8 | .029 | 74 | +14 | −5 |
| denim (cotton/ polyster) | 8.9 | .035 | 73 | +13 | −6 |
| power knit (#90151) | 9.1 | .037 | 71 | +11 | −8 |
| LYCRA Brand spandex | 10.4 | .032 | 69 | +9 | −10 |

*quiet touch fastener unattached 60 db
**quiet touch fastener attached but not decoupled (control sample) 79 db The implications of the noise level reductions listed above can best be appreciated using the mathematical definition of the decibel unit. It is expressed by the following equation:

$$n = 10 \log_{10} E/E_0$$

where:

n=number of db's

E=intensity of one sound $E_0$=intensity of another sound

Utilizing this equation to evaluate the change, compared to the control sample, of the first and last results of the above data:

$-2 = 10 \log E/E_0$ $E/E_0 = 0.63$ $E = 0.63\ E_0$ which indicates a 37% reduction in noise intensity $-10 = 10 \log E/E_0$ $E/E_0 = 0.10$ $E = 0.10\ E_0$ which indicates a 90% reduction in noise intensity Therefore, LYCRA Brand spandex material is an effective decoupling material since its 10 decibel attenuation represents a 90% reduction in sound produced upon separation of engaged quiet touch fasteners compared to the control sample.

By the above arrangements, we have in effect decoupled or dampened the backing material from the garment to effectively reduce the noise produced by the garment upon separation of the quiet touch fastener members to the sound levels obtained by such touch fasteners when unattached to a garment.

Wherefore, having thus described our invention, we claim:

1. A touch fastener mounting system comprising a touch fastener component having a planar backing member carrying engaging elements extending from one surface thereof, said backing member being attached by way of attachment means to a first member; said elements of said touch fastener component being capable of engaging elements of a mating fastener component, carried by a second member, to releasably fasten said first member to said second member; the attachment means including means for isolating said first member from noise producing energy generated by said backing member upon separation of said mating fastener components.

2. A touch fastener mounting system according to claim 1, wherein said noise isolating means comprises an intermediate member for interconnecting and isolating said backing member from said first member.

3. A touch fastener mounting system according to claim 2 wherein said intermediate member comprises two separate members, each interconnecting an edge portion of said backing member with said first member.

4. A touch fastener mounting system according to claim 2, wherein said intermediate member is wider than the width of said backing member, said intermediate member being attached at opposite edges thereof to said first member and, at locations intermediate said opposite edges, to the edge portions of said backing member.

5. A touch fastener mounting system according to claim 2, wherein said intermediate member is a spandex material.

6. A touch fastener according to claim 2, wherein said intermediate member is a power net material.

7. A touch fastener according to claim 2, wherein said intermediate member is an elastomeric material.

8. A touch fastener according to claim 2, wherein said intermediate member is a non-woven material.

9. A touch fastener mounting system according to claim 2, wherein said intermediate member is a braided material.

10. A touch fastener mounting system according to claim 2, wherein said intermediate member is a foam material.

11. A touch fastener mounting system according to claim 2, wherein said intermediate member is a diamond mesh material.

12. A touch fastener mounting system according to claim 1, wherein the first mentioned touch fastener component includes means for reducing coupling of noise producing vibration from said backing material into the surrounding air.

13. A touch fastener mounting system according to claim 12, wherein said noise coupling reduction means is characterized by said backing material having a high mass material, relative to the mass of said engaging elements, attached to the other surface of said backing material.

14. A touch fastener mounting system according to claim 13, wherein said high mass material is lead vinyl.

15. A touch fastener mounting system according to claim 12, wherein said noise coupling reduction means is characterized by said backing material comprising a lattice structure having low ability for transmitting vibrations induced therein into the air surrounding it.

16. A touch fastener mounting system according to claim 15, wherein said lattice structure is comprised of at least 50% air space.

17. A touch fastener mounting system according to claim 15, wherein said lattice structure is comprised of at least 70% air space.

18. A garment having a touch fastener mounting system attached to one surface thereof, said touch fastener mounting system comprising a touch fastener component having a planar backing member carrying engaging elements extending from one surface thereof, the other surface of said backing member being attached by attachment means to said garment; said touch fastener component being capable of engaging elements of a mating fastener component, to releasable fasten said garment to said mating fastener component; the attachment means including means for isolating said garment from noise producing energy generated by said backing member upon separation of said mating fastener components.

19. A touch fastener mounting system comprising a touch fastener component having a planar backing member carrying engaging elements extending at discrete points from one surface thereof, the other surface of said backing member being attached by attachment means to a first member; said touch fastener component being capable of engaging elements of a mating fastener component, carried by a second member, to releasably fasten said first member to said second member; said first member having means, attached to a rear surface of said first member, for dampening noise producing energy generated by said backing member and transmitted to said first member upon separation of said mating fastener components.

20. A touch fastener mounting system according to claim 19, wherein said dampening means is a high mass material, relative to the mass of the first member.

21. A touch fastener mounting system according to claim 20, wherein said high mass material is lead vinyl.

* * * * *